US008986519B2

(12) United States Patent
Kim et al.

(10) Patent No.: US 8,986,519 B2
(45) Date of Patent: Mar. 24, 2015

(54) ELECTROWINNING APPARATUS AND METHOD FOR RECOVERING USEFUL METALS FROM AQUEOUS SOLUTIONS

(75) Inventors: Soo-Kyung Kim, Daejeon (KR); Jae-Chun Lee, Daejeon (KR); Jin-Ki Jeong, Daejeon (KR); Jeong-Soo Sohn, Daejeon (KR); Young Min Oh, Goyang-si (KR)

(73) Assignee: Korea Institute of Geoscience and Mineral Resources (KIGAM), Daejeon (KR)

( * ) Notice: Subject to any disclaimer, the term of this patent is extended or adjusted under 35 U.S.C. 154(b) by 168 days.

(21) Appl. No.: 13/523,139

(22) Filed: Jun. 14, 2012

(65) Prior Publication Data

US 2012/0318682 A1 Dec. 20, 2012

(30) Foreign Application Priority Data

Jun. 16, 2011 (KR) ..... 10-2011-0058353

(51) Int. Cl.

| | |
|---|---|
| ***C25C 7/02*** | (2006.01) |
| ***C25C 7/00*** | (2006.01) |
| ***C25C 1/00*** | (2006.01) |
| ***C25C 1/20*** | (2006.01) |

(52) U.S. Cl.

CPC ... *C25C 7/02* (2013.01); *C25C 1/20* (2013.01); *C25C 7/00* (2013.01)

USPC ..... 204/272; 204/233

(58) Field of Classification Search

CPC ..... C25C 7/00

See application file for complete search history.

(56) References Cited

U.S. PATENT DOCUMENTS

| | | | | | |
|---|---|---|---|---|---|
| 3,003,942 | A * | 10/1961 | Cedrone | ..... | 204/272 |
| 3,640,700 | A * | 2/1972 | Suzuki et al. | ..... | 75/10.23 |
| 4,028,212 | A * | 6/1977 | Bowen et al. | ..... | 204/272 |
| 5,262,019 | A * | 11/1993 | Snyder et al. | ..... | 205/596 |
| 5,460,706 | A * | 10/1995 | Lisboa | ..... | 204/269 |
| 2014/0144788 | A1 * | 5/2014 | Barton | ..... | 205/704 |

* cited by examiner

*Primary Examiner* — Keith Hendricks
*Assistant Examiner* — Salil Jain
(74) *Attorney, Agent, or Firm* — Ladas & Parry LLP

(57) ABSTRACT

An electrowinning apparatus and method are provided. The electrowinning apparatus includes: an electrolytic cell including a body portion which has an inlet for introducing an aqueous solution containing metal ions into the body portion and a conical portion which is gradually reduced in diameter from top to bottom and disposed under the body portion; a ring-shaped cathode coupled to an inner circumferential surface of the body portion of the electrolytic cell and having an entrance hole which extends from an outer circumferential surface of the cathode through to an inner circumferential surface of the cathode and is connected to the inlet of the electrolytic cell; and a hollow anode having an upper end disposed outside the electrolytic cell and inserted into the cathode. In the electrowinning method, a metal can be recovered from an aqueous solution containing a low concentration of metal ions using the above cyclone-shaped electrowinning apparatus.

14 Claims, 5 Drawing Sheets

ELECTROWINNING APPARATUS AND METHOD FOR RECOVERING USEFUL METALS FROM AQUEOUS SOLUTIONS

CROSS-REFERENCE TO RELATED APPLICATION

This application claims the benefit under 35 U.S.C. §119 (a) of a Korean Patent Application No. 10-2011-0058353, filed on Jun. 16, 2011, the entire disclosure of which is incorporated herein by reference for all purposes.

BACKGROUND

1. Field

The following description relates to recycling technology for recovering useful metals from waste solutions and reusing the recovered metals, and more particularly, to electrowinning technology for recovering useful metals.

2. Description of the Related Art

Generally, useful metals are contained in waste solutions, metal plating waste solutions, or washing water generated in the electronic industry, for example, in a semiconductor fabrication process. In particular, a considerable amount of noble metal is contained in waste solutions or washing water generated in industrial processes that use noble metals. Therefore, such noble metals need to be recovered and reused.

Some of the widely used methods of recovering noble metals from waste solutions or washing water include ion-exchange resin, activated carbon, and electrowinning. Solutions from which useful metals have been recovered are neutralized and then discarded and then recirculated for use.

Of the above recovery methods, electrowinning is a method of depositing a target noble metal on the cathode surface by electrolytic reduction of an aqueous solution or a leach solution containing noble metals. In the electrowinning method, a high-purity metal can be obtained directly from a solution without an intermediate process of producing a crude metal, and a solvent can be regenerated and reused in a leaching process.

Despite these advantages, electrowinning suffers from a low metal recovery rate when the concentration of metal ions in an aqueous solution is low although it is easily applicable when the concentration of metal ions in the aqueous solution is high.

That is, active electrowinning occurs when the concentration of a metal in an aqueous solution is about 30 g/l but is not possible when the concentration of the metal in the aqueous solution is only several g/l. In particular, when metal ions are contained in the aqueous solution at an extremely low concentration of 1 g/l, the speed of the metal ions moving to the cathode surface is very low, unlike when the metal ions are contained at a high concentration. Accordingly, it is not easy to recover the metal.

Various technologies are being developed to increase the rate and amount of electrodeposition in order to recover noble metals from waste solutions containing an extremely low concentration of metal ions. However, no satisfactory results have been obtained.

SUMMARY

The following description relates to an electrolytic cell which is structured to effectively recover a metal from an aqueous solution containing a low concentration of metal ions and an electrowinning method using the electrolytic cell.

In one general aspect, there is provided an electrowinning apparatus including: an electrolytic cell including a cylindrical body portion which has an inlet for introducing an aqueous solution containing metal ions into the body portion and a conical portion which is gradually reduced in diameter from top to bottom and disposed under the body portion; a ring-shaped cathode coupled to an inner circumferential surface of the body portion of the electrolytic cell and having an entrance hole which extends from an outer circumferential surface of the cathode through to an inner circumferential surface of the cathode and is connected to the inlet of the electrolytic cell; and a hollow anode having an upper end disposed outside the electrolytic cell and inserted into the cathode.

According to the present invention, the anode includes a plurality of holes which extend from an outer circumferential surface of the anode through to an inner circumferential surface of the anode.

According to an embodiment of the present invention, the anode may be made of titanium coated with iridium oxide.

In addition, the cathode is made of titanium, and an outlet for discharging the aqueous solution is formed in a bottom of the conical portion.

According to an embodiment of the present invention, the inlet of the electrolytic cell and the entrance hole of the cathode are formed such that the aqueous solution passing through the entrance hole is guided to rotate along the inner circumferential surface of the cathode. Therefore, the aqueous solution creates turbulence within the electrolytic cell.

A connection hole is formed in the electrolytic cell, and the cathode is electrically connected to a power supply by the connection hole.

The cathode is a metal that dissolves in an acidic solution. Any one of zinc, iron, tin, nickel, and copper can be used as the cathode.

In another aspect, there is provided an electrowinning method including: connecting a ring-shaped cathode and a hollow anode disposed inside the cathode to a power supply; introducing an aqueous solution containing metal ions into the cathode so that the aqueous solution introduced into the cathode sinks while creating turbulence by rotating along an inner circumferential surface of the cathode and then is discharged through a through hole inside the anode; and letting the aqueous solution electrically connect the cathode and the anode so that metal ions in the aqueous solution are reduced to deposit on a surface of the cathode.

In the present invention, a concentration of the metal ions in the aqueous solution is 1 g/L or less.

Other features and aspects will be apparent from the following detailed description, the drawings, and the claims.

Figure 1:
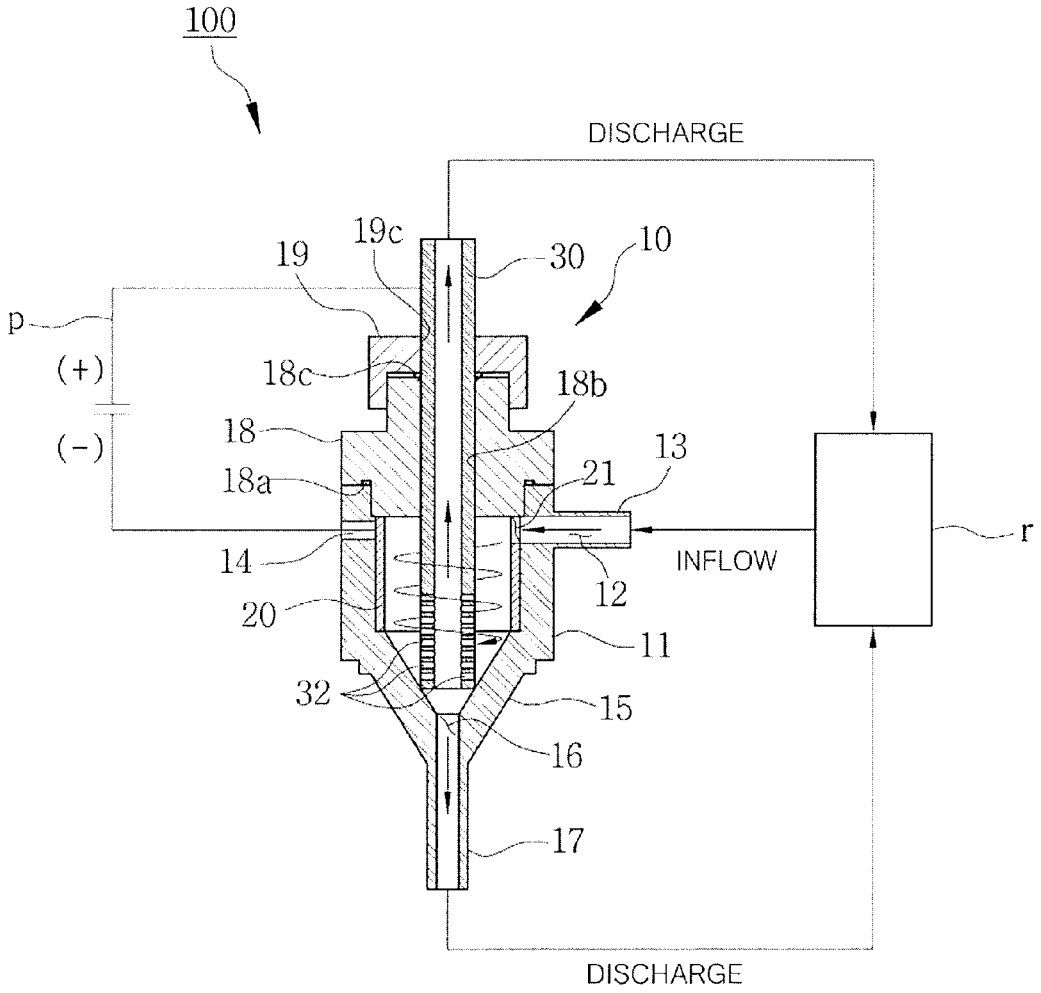
FIG. 1 is an installed view of an electrowinning apparatus according to an embodiment of the present invention.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

An electrowinning apparatus according to an embodiment of the present invention will now be described more fully with reference to the accompanying drawings.

Figure 2:
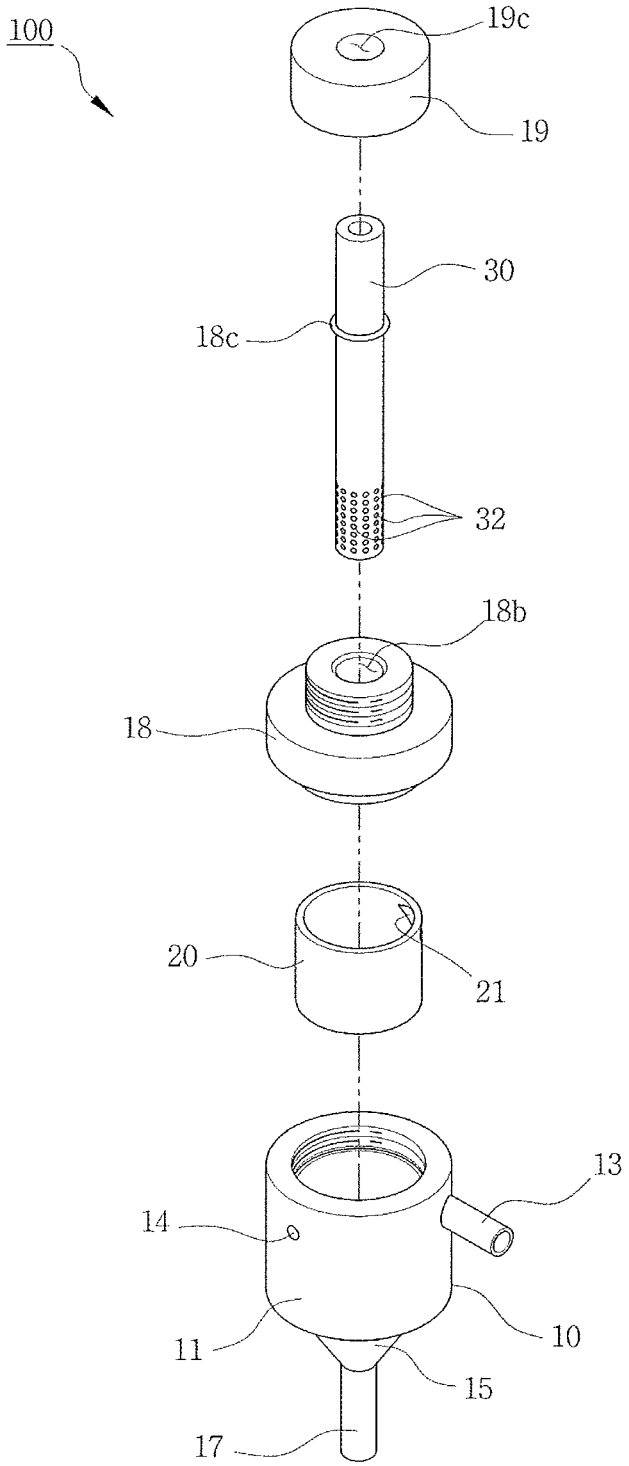
FIG. 2 is a schematic exploded perspective view of the electrowinning apparatus shown in FIG. 1.
Figure 3:
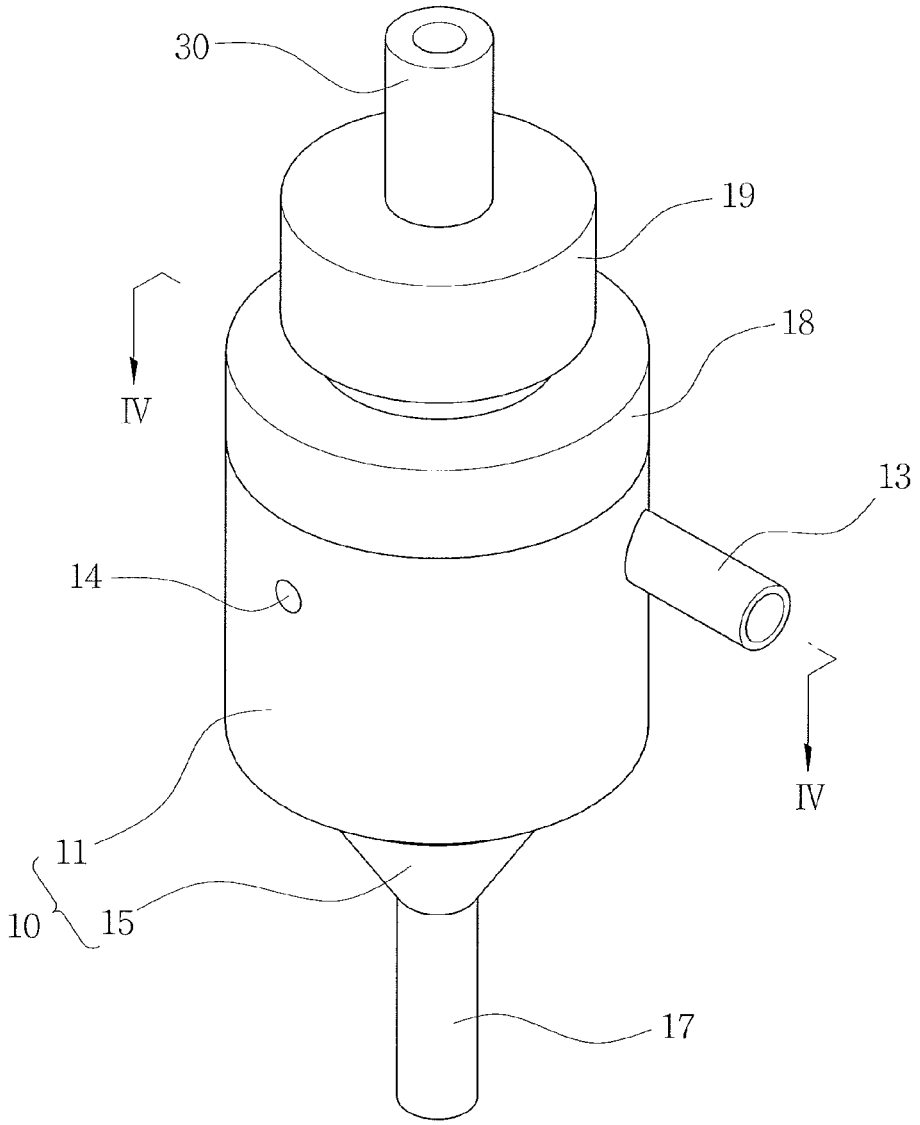
FIG. 3 is an assembled view of the electrowinning apparatus shown in FIG. 2.
Figure 4:
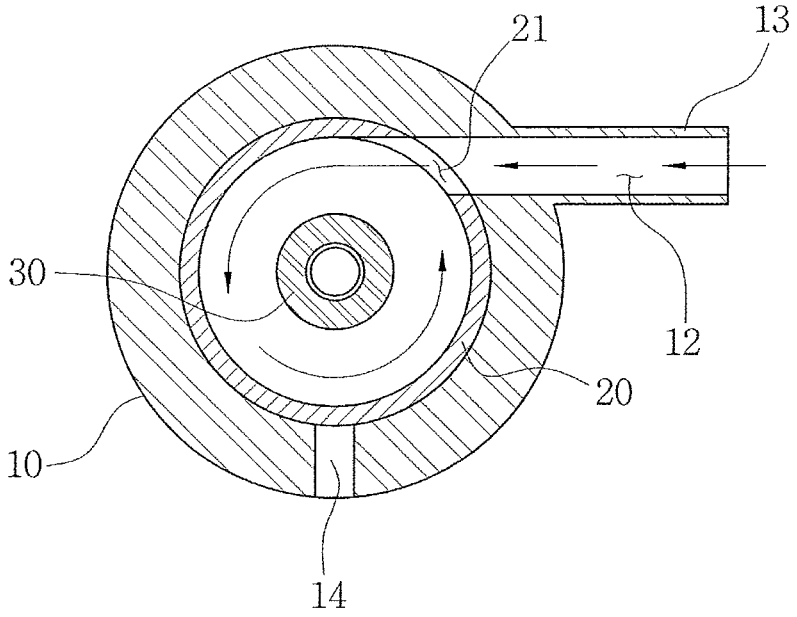
FIG. 4 is a schematic cross-sectional view taken along the line IV-IV of FIG. 3.

FIG. 1 is an installed view of an electrowinning apparatus 100 according to an embodiment of the present invention. FIG. 2 is a schematic exploded perspective view of the electrowinning apparatus 100 shown in FIG. 1. FIG. 3 is an assembled view of the electrowinning apparatus 100 shown in FIG. 2. FIG. 4 is a schematic cross-sectional view taken along the line IV-IV of FIG. 3.

Referring to FIGS. 1 through 4, the electrowinning apparatus 100 according to the current embodiment includes an electrolytic cell 10, a cathode 20, an anode 30, and a power supply p.

The electrolytic cell 10 provides a space in which an electrowinning process is performed. In the current embodiment, the electrolytic cell 10 is cyclone-shaped and includes a body portion 11 and a conical portion 15.

In the current embodiment, the body portion 11 is cylindrical and has the same diameter from top to bottom. An inlet 12 through which an aqueous solution can flow into the body portion 11 is formed in a side of the body portion 11. The inlet 12 extends from an outer circumferential surface of the body portion 11 through to an inner circumferential surface of the body portion 11. An inlet port 13 for guiding an aqueous solution to the inlet 12 is connected to the inlet 12. In addition, a connection hole 14 is formed in a side of the body portion 11. An electric wire for supplying power to the cathode 20 may be inserted into the connection hole 14.

In the current embodiment, the conical portion 15 extends from a bottom of the body portion 11 and is gradually reduced in diameter from top to bottom thereby to form a conical shape. An outlet 16 through which an aqueous solution can flow out of the body portion 11 is provided in a bottom of the conical portion 15. An outlet port 17 for discharging an aqueous solution to the outside is connected to the outlet 16.

In addition, a sealing cap 18 for opening or closing an inner space of the body portion 11 is provided. That is, an internal screw thread is formed on an upper internal circumferential surface of the body portion 11, and an external screw thread is formed on an outer circumferential surface of the sealing cap 18. Therefore, the sealing cap 18 is screw-coupled to the body portion 11. An O ring 18*a* is interposed between the sealing cap 18 and the body portion 11 to ensure sealing.

An insertion hole 18*b* extends from a top surface of the sealing cap 18 through to a bottom surface of the sealing cap 18, and the anode 30 shaped like a baton is inserted into the insertion hole 18*b*. An O ring 18*c* surrounds the insertion hole 18*b* to fill a gap between the anode 30 and the insertion hole 18*b*. A compression cap 19 is screw-coupled onto the sealing cap 18. The compression cap 19 tightly attaches the O ring 18*c* to the top surface of the sealing cap 18, thereby increasing sealing reliability. A through hole 19*c* is formed in a center of the compression cap 19, and the anode 30 is inserted into the through hole 19*c*.

The cathode 20 is ring-shaped and inserted into the body portion 11 of the electrolytic cell 10. In the current embodiment, the cathode 20 is shaped like a cylinder with the same diameter from top to bottom. An entrance hole 21 extends from an outer circumferential surface of the cathode 20 through to an inner circumferential surface of the cathode 20. The entrance hole 21 is formed at a location corresponding to the inlet 12 of the body portion 11 and thus connected to the inlet 12 of the body portion 11. An aqueous solution containing metal ions flows into the cathode 20 through the inlet 12 and the entrance hole 21.

In the present invention, an aqueous solution introduced into the cathode 20 should create turbulence in the electrolytic cell 10. To this end, the aqueous solution should be introduced into the cathode 20 in a roughly tangential direction of the cylindrical cathode 20. That is, if it is assumed that the cylindrical cathode 20 is a circle, the aqueous solution should be introduced into the cathode 20 in a direction of a tangent line to an edge of the circle. Only when the aqueous solution is introduced into the cathode 20 in the tangential direction of the cathode 20 can the aqueous solution rotate along the inner circumferential surface of the cathode 20 to create turbulence. For example, if the aqueous solution flows toward a center of the cathode 20 along a radius direction, no turbulence is created in the electrolytic cell 10. Thus, desired effects cannot be obtained.

The cathode 20 is electrically connected to the power supply p by the connection hole 14 formed in the body portion 11.

In the current embodiment, all metals that may or may not dissolve in an acidic solution can be used as a cathode. Generally, an insoluble metal that does not dissolve in an acidic solution is used as an electrode in an electrowinning process. Thus, in the current embodiment, an insoluble metal (e.g., titanium) can also be used as a cathode.

In another embodiment of the present invention, however, a metal that dissolves in a hydrochloric acid solution or a sulfuric acid solution may be used. Examples of the metal may include iron, zinc, tin, nickel, and copper. As will be described later, a target metal is deposited on the surface of a cathode as a result of an electrowinning process. Therefore, a follow-up process for separating the target metal (e.g., gold) from the cathode is required. If a metal that dissolves in acid is used as the cathode, noble metals (such as gold and platinum) can be easily separated from the cathode since they do not dissolve in an acidic solution while the cathode dissolves in the acidic solution.

The anode 30 is shaped like a long baton and is inserted into the electrolytic cell 10 through the through hole 19*c* of the compression cap 19 and the insertion hole 18*b* of the sealing cap 18. An upper part of the anode 30 is electrically connected to the power supply p.

In addition, the anode 30 includes a through hole therein. Therefore, the inside of the electrolytic cell 10 is connected to the outside via the through hole of the anode 30. As will be described later, after an aqueous solution inside the electrolytic cell 10 flows down to the conical portion 15, a portion of the aqueous solution is discharged to the outside through the outlet 16 formed in the bottom of the conical portion 15, and the other portion of the aqueous solution is discharged to the outside through the inside of the anode 30.

The upper part of the anode 30 and the outlet 16 formed in a bottom of the electrolytic cell 10 are all connected to a reservoir r which stores an aqueous solution. Also, the inlet 12 of the electrolytic cell 10 is connected to the reservoir r. Therefore, a circulation path of the aqueous solution is formed between the reservoir r and the electrolytic cell 10.

A plurality of holes 32 are formed in a lower part of the anode 30. The holes 32 increase a contact area between the anode 30 and an aqueous solution to facilitate the reaction of the anode 30 with the aqueous solution.

In the current embodiment, the anode 30 is made of titanium. Iridium oxide is coated on the titanium to reinforce strength. An anode formed by coating titanium with iridium oxide remains stable without dissolving in a strong acidic solution or a strong alkaline solution.

An electrowinning process typically requires a high decomposition voltage. For example, when graphite is used as an anode, an overvoltage applied to the anode may weaken the surface of the graphite anode. Thus, the anode may be abraded by a fluid flowing at high speed. However, if an electrode formed by coating titanium with iridium oxide is used as the anode, it remains intact without being abraded by a high overvoltage and a high fluid velocity due to its mechanical strength. Accordingly, this anode exhibits excellent stability.

An electrowinning method using the electrowinning apparatus 100 configured as described above will now be described.

First, the cyclone-shaped electrowinning apparatus 100 configured as described above is prepared. Key features of the configuration of the electrowinning apparatus 100 are that the cathode 20 is ring-shaped, that a lower part of the electrolytic cell 10 is conical, and that the anode 30 is hollow. In addition, an aqueous solution is introduced into the electrolytic cell 10 in the tangential direction of the ring-shaped cathode 20, as shown in the cross-sectional view of FIG. 4.

In the electrowinning apparatus 100 configured as described above, the power supply p is connected to each of the cathode 20 and the anode 30, and an aqueous solution containing metal ions (such as gold and platinum) is introduced from the reservoir r into the electrolytic cell 10.

Here, the aqueous solution may be introduced into the cathode 20 at a velocity of 2 to 10 m/sec. The aqueous solution introduced at a velocity of less than 2 m/sec cannot create turbulence, thus failing to produce desired results. On the other hand, a velocity of more than 10 m/sec is uneconomical.

The aqueous solution introduced in the tangential direction of the ring-shaped cathode 20 sinks while rotating along the inner circumferential surface of the cathode 20. In the conical portion 15, a portion of the aqueous solution is discharged through the outlet 16, and the other portion of the aqueous solution is introduced into the through hole of the anode 30 to rise and be discharged. In this way, the aqueous solution introduced into the cyclone-shaped electrolytic cell 10 in the tangential direction is discharged through the inside of the anode 30 by forming a rising current in the lower part of the electrolytic cell 10.

The anode 30 and the cathode 20 are electrically connected to each other by the aqueous solution inside the electrolytic cell 10, and metal ions such as gold and platinum are reduced by electrons emitted from the cathode 20 to deposit on the surface of the cathode 20 in a solid state.

Through the above process, the aqueous solution continuously circulates between the reservoir r and the electrolytic cell 10. The continuous circulation of the aqueous solution causes most of the metal ions contained in the aqueous solution to be electron as they are deposited on the surface of the cathode 20.

In a conventional electrowinning process, metals can be recovered effectively only when the concentration of metal ions in an aqueous solution is 30 g/L or more. However, in the present invention, electrowinning is possible even when the concentration of metal ions in an aqueous solution is 1 g/L or less. This is because the cyclone-shaped electrolytic cell 10 is used.

When a cyclone-shaped electrolytic cell is used as in the present invention, the moving velocity of metal ions is increased. Therefore, unlike in the conventional electrowinning process, metals can be recovered even when metal ions are contained in an aqueous solution at a low concentration.

That is, in a cyclone-shaped electrolytic cell suggested in the present patent application, a solution creates turbulence at a flow velocity of approximately 2 m/sec. The creation of the turbulence can be identified from the relationship between a Reynolds number (Re) which is a dimensionless constant indicating flow velocity and a Sherwood number (Sh) which is a dimensionless constant indicating mass transfer. This is due to unique geometric characteristics of a cyclone. In the turbulence, the mass transfer of metal ions increases rapidly. That is, since a thickness of a diffusion layer (i.e., a distance over which metal ions have to travel) is reduced, a distance over which the metal ions diffuse to the surface of a cathode is reduced, resulting in increased reaction speed. In particular, random fluctuations of the metal ions, which are a unique characteristic of the turbulence, instantaneously move the metal ions to the surface of the cathode, thereby rapidly increasing the mass transfer of the metal ions.

Figure 5:
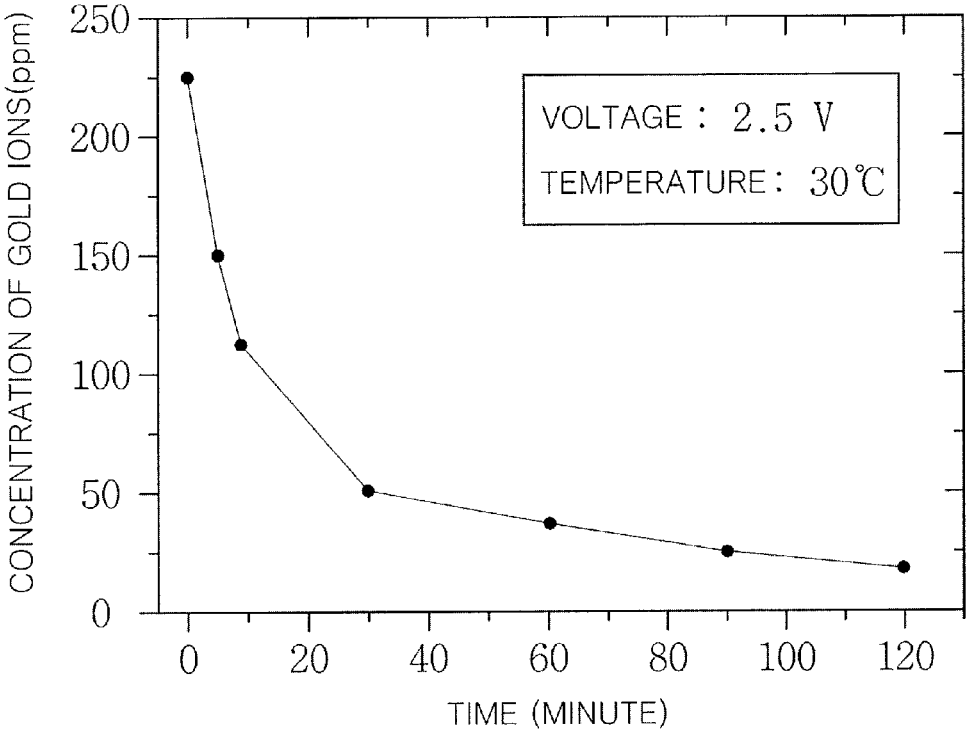
FIG. 5 is a graph illustrating the results of an experiment on the effect of an electrowinning apparatus and method according to the present invention.

The present applicant performed an electrowinning experiment using an electrowinning apparatus and method according to the present invention. The results are shown in a graph of FIG. 5.

In the experiment, electrowinning was performed on an aqueous solution containing gold by using the electrowinning apparatus and method according to the present invention. A voltage of 2.5 V was applied at a temperature of 30° C., and the aqueous solution was circulated for about two hours. The concentration of gold ions in the aqueous solution was approximately 225 ppm. As a result of the electrowinning performed by circulating the aqueous solution between a reservoir and an electrolytic cell for two hours, the concentration of the gold ions dropped to approximately 20 ppm, and almost 90% of the gold ions were extracted in the solid state.

As described above, the present invention uses a cyclone-shaped electrolytic cell. Since the cyclone-shaped electrolytic cell noticeably increases the moving speed of metal ions in an aqueous solution, more than 90% of a metal can be recovered even when the metal is contained in the aqueous solution at a low concentration of 1 g/L.

Although an insoluble metal can be used as a cathode, a soluble metal such as iron or zinc is used as the cathode. Therefore, if the cathode and noble metals deposited on the surface of the cathode as a result of an electrowinning process are immersed in an acidic solution, the noble metals can be easily separated from the cathode since the noble metals do not dissolve in the acidic solution while the cathode dissolves in the acidic solution.

Furthermore, an anode formed by coating titanium with iridium oxide can increase durability.

While the present invention has been particularly shown and described with reference to exemplary embodiments thereof, it will be understood by those of ordinary skill in the art that various changes in form and detail may be made therein without departing from the spirit and scope of the present invention as defined by the following claims.

What is claimed is:

1. An electrowinning apparatus comprising:

an electrolytic cell comprising:

a body portion which has an inlet for introducing an aqueous solution containing metal ions into the body portion and a conical portion which is gradually reduced in diameter from top to bottom and disposed under the body portion;

a sealing cap screw-coupled to the body portion, wherein the sealing cap comprises an insertion hole;

a compression cap screw-coupled to the onto the sealing cap wherein the compression cap comprises a through hole formed through a center of the compression cap;

a ring-shaped cathode coupled to an inner circumferential surface of the body portion of the electrolytic cell and having an entrance hole which extends from an outer circumferential surface of the cathode through to an inner circumferential surface of the cathode and is connected to the inlet of the electrolytic cell; and a hollow anode having an upper end disposed outside the electrolytic cell and inserted into the cathode.

2. The electrowinning apparatus of claim 1, wherein the anode comprises a plurality of holes which extend from an outer circumferential surface of the anode through to an inner circumferential surface of the anode.

3. The electrowinning apparatus of claim 1, wherein the anode is made of titanium coated with iridium oxide.

4. The electrowinning apparatus of claim 1, wherein an outlet for discharging the aqueous solution is formed in a bottom of the conical portion.

5. The electrowinning apparatus of claim 1, wherein the inlet of the electrolytic cell and the entrance hole of the cathode are formed such that the aqueous solution passing through the entrance hole is guided to rotate along the inner circumferential surface of the cathode.

6. The electrowinning apparatus of claim 1, wherein a connection hole is formed in the electrolytic cell, and the cathode is electrically connected to a power supply by the connection hole.

7. The electrowinning apparatus of claim 1, wherein the cathode is a metal that dissolves in an acidic solution.

8. The electrowinning apparatus of claim 7, wherein the cathode is any one of zinc, tin, nickel, and copper.

9. The electrowinning apparatus of claim 1, wherein the electrolytic cell further comprising:

a first O-ring interposed between the sealing cap and the body portion; and a second O-ring interposed between the compression cap and the sealing cap.

10. The electrowinning apparatus of claim 1, wherein the anode is inserted into the through hole of the compression cap and through the insertion hole of the sealing cap.

11. The electrowinning apparatus of claim 8, wherein the cathode comprises zinc.

12. The electrowinning apparatus of claim 8, wherein the cathode comprises tin.

13. The electrowinning apparatus of claim 8, wherein the cathode comprises nickel.

14. The electrowinning apparatus of claim 8, wherein the cathode comprises copper.

* * * * *